United States Patent [19]

Perkins

[11] Patent Number: 4,997,189

[45] Date of Patent: Mar. 5, 1991

[54] PUTTING TEACHING AND LEARNING APPARATUS AND METHOD

[76] Inventor: Sonnie J. Perkins, 14105 21st Dr. SE., Mill Creek, Wash. 98012

[21] Appl. No.: 486,094

[22] Filed: Feb. 28, 1990

[51] Int. Cl.[5] ..... A63B 69/36

[52] U.S. Cl. ..... 273/181 H; 273/35 A; 273/186 A; 273/192; 273/194 A

[58] Field of Search ..... 273/186 A, 186 R, 186 C, 273/186 AA, 186 RA, 181 H, 35 A, 192, 194 A, 167 J

[56] References Cited

U.S. PATENT DOCUMENTS

| | | | |
|---|---|---|---|
| D. 272,257 | 1/1984 | Perkins | D21/221 |
| D. 294,617 | 3/1988 | Perkins | D21/220 |
| D. 295,205 | 4/1988 | Perkins | D21/219 |
| D. 295,206 | 4/1988 | Perkins | D21/220 |
| 3,194,563 | 7/1965 | Mackniesh | 273/186 A |
| 3,802,709 | 4/1974 | Elkins | 273/186 A |
| 4,000,902 | 1/1977 | Perkins | 273/164 |
| 4,231,576 | 11/1980 | Perkins | 273/183 D |
| 4,251,077 | 2/1981 | Pelz et al. | 273/194 A |
| 4,306,722 | 12/1981 | Rusnak | 273/186 R |
| 4,341,384 | 7/1982 | Thackrey | 273/186 A |
| 4,456,257 | 7/1984 | Perkins | 273/186 R |
| 4,607,846 | 8/1986 | Perkins | 273/171 |

*Primary Examiner*—Benjamin Layno
*Attorney, Agent, or Firm*—William W. Haefliger

[57] ABSTRACT

A method of teaching and learning putting, via accurate visual feedback, and employing a putter head having a light reflective surface, a golf ball zone, a light beam generator, a beam target surface, and a local (cup) zone toward which a putter struck ball travels on a putting surface, the steps that include: locating the putter head directly behind the ball zone on the putting surface; operating the generator to direct a light beam at the putter for reflection by the putter, or by a face carried by the putter, toward the target surface to impinge thereon at an impingement locus; and swinging the putter in a manner to strike a ball at the ball zone and stroke it toward the local (cup) zone, thereby causing the impingement locus of the reflected beam to trace a detectable travel pattern providing indication as to whether or not correct putter alignment forces would be applied to a struck ball to cause it to travel to the local (cup) zone.

17 Claims, 3 Drawing Sheets

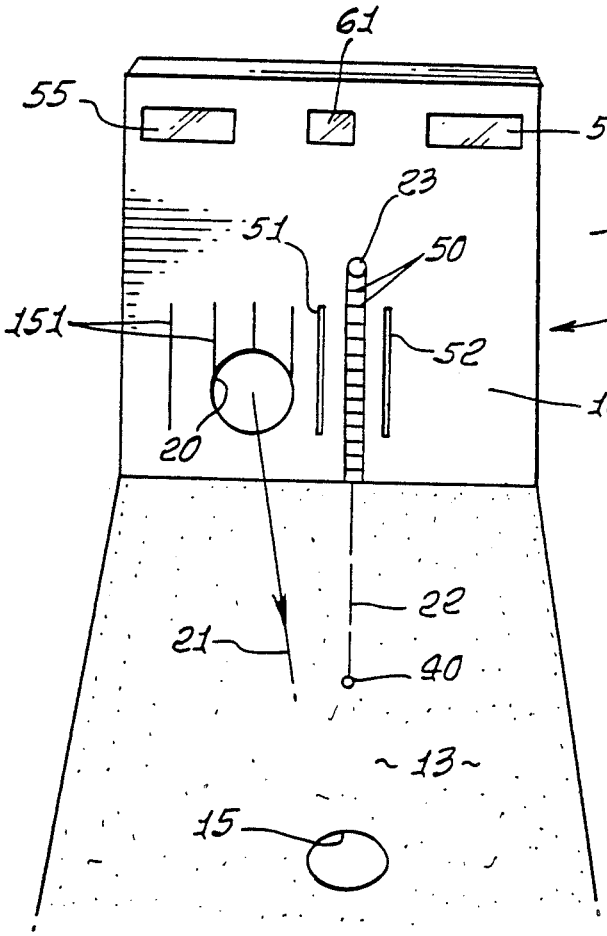
FIG. 8.
FIG. 9.
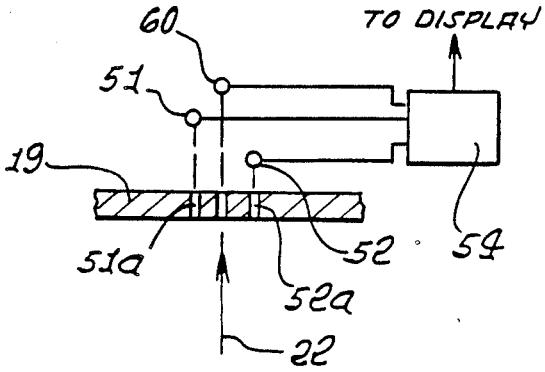
FIG. 11.
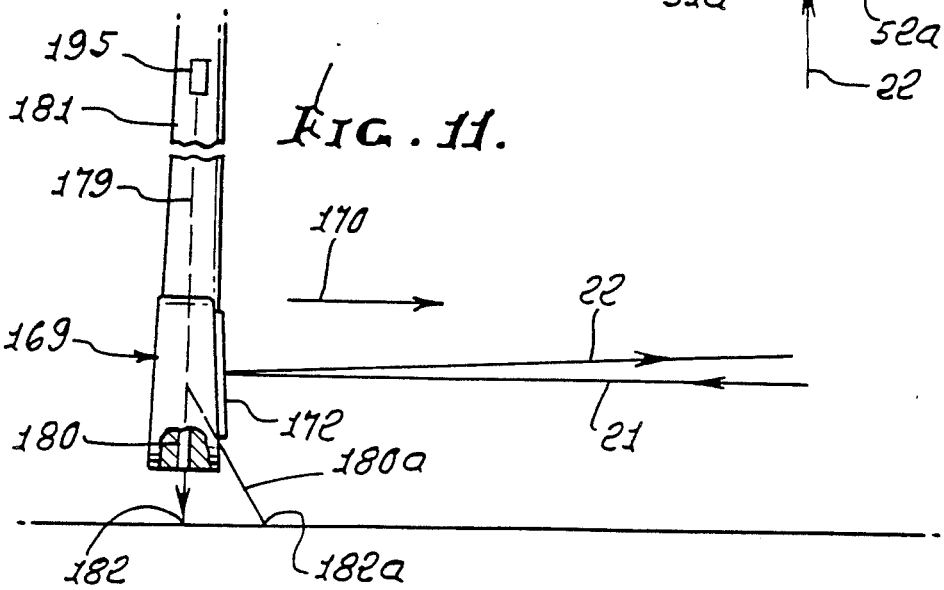

PUTTING TEACHING AND LEARNING APPARATUS AND METHOD

BACKGROUND OF THE INVENTION

This invention relates generally to golf ball putting, and more particularly concerns a method and apparatus facilitating tracking and/or learning of precision putting.

There is need for a means to enable the golfer to be confident of his initial aim at the target and his execution during play. Enhanced practice can achieve that goal. Accurate putting demands precise application of distance and direction factors. Distance problems are easily seen, and can be corrected; however, alignment factors are less obvious. First, it is difficult to aim the putter. There is need for apparatus that allows an accurate check of putter aim, and which allows the golfer to actually visualize correct putter direction, thus making it possible to repeat on the golf course. Also, there is need for apparatus that allows a check on the quality of the putting motion itself.

The direction of a putt is greatly affected by the slope and condition of the putting surface. However, once a target path is chosen, putting direction is affected by three factors. One is the centeredness of contact. Off center impact can cause the putter blade to open or close. The second factor is the actual path of the club head. The third and most important factor is the direction of the club face during impact. It is almost impossible for a golfer to see, i.e., visualize, these alignment problems. In fact, certain erroneous combinations of these factors will result in a perfect looking putt result. In effect, two wrongs make a right. If the initial aim is wrong, the stroke must be wrong to correct the result; however, most golfers do not want to learn this way. The simplest method is correct aim and matching stroke. There is thus need for apparatus that allows the golfer to actually see each alignment factor during practice execution and to explore ways to prevent or correct any alignment problems during practice.

Devices have been developed that in some way artificially restrict the club head path, and that show club face alignment at impact in a relatively inaccurate manner. Practice putters and devices have been developed that allow control of ball contact at impact. If these devices in any way force unnatural muscle response, they teach something that cannot apply to putting. There is need for apparatus that allows the golfer to ascertain the quality of directional factors while he is free to feel or experience the correct muscle feel. In the meantime, the brain is learning an accurate proprioceptor patterning for accurate putting. Accordingly, there is need for means to much more accurately indicate to the golfer whether or not the putter face is being twisted, whether the putter head path is in the chose and proper direction and whether the ball is being contacted squarely

SUMMARY OF THE INVENTION

It is a major object of the invention to provide method and apparatus to meet the above need, and to provide additional advantages as will appear. Basically, the invention involves the reflection at the putter of a laser or other indicating beam directed at the putter and the impingement of the reflected beam on a target so that when the putter is correctly stroked, the reflected beam impingement zone will fall on, or track on, a predetermined area of the target; and if the stroke is incorrect, the beam will not fall on, or track on, the predetermined target area. The arrangement is such that the golfer will visually see or detect his error in aim, and also see or detect that error during the putter stroke, such as both during back-stroke of the putter, and forward stroking to impact the ball.

In accordance with the invention, a putter head having or carrying a light reflective surface is employed, together with a light beam generator, and the head is addressed to a golf ball zone (with or without a ball) such that the head is to be stroked toward a local (cup) zone on a putting surface. In this environment, the method includes the steps:

(a) locating the putter head directly behind the ball zone on the putting surface, (b) operating the generator to direct a light beam at the putter for reflection at the putter toward the target surface to impinge thereon at an impingement locus, (c) and swinging the putter in a manner to strike a ball at the zone and stroke it toward the local zone, thereby causing the impingement locus of the reflected beam to trace a detectable travel pattern providing indication as to whether or not a struck ball would travel to the local zone, and which stroke deviations occurred.

As will be seen, the light (such as a laser beam) reflecting surface may be provided at the ball striking surface of the putter, or it may be offset from the surface, as for example directly above the putter head. The target surface may be located in front of or behind the putter.

It is another object to provide a target body to define a first portion of the target surface, which is oriented to face toward the putter head. In this regard, the target is preferably constructed to pass the beam through the target body toward the putter head. Further, the putting surface itself may form a second portion of the target surface, and the putter is swung to cause the impingement locus to travel off the first portion of the target surface onto the second portion of the target surface, and then to travel off the second portion of the target surface back onto the first portion of the target surface during putter forward stroking.

Apparatus embodying the invention is characterized by:

(a) the putter head located directly behind the ball zone on the putting surface, (b) the generator operating to direct a light beam at the putter for reflection at the putter toward the target surface to impinge thereon at an impingement locus, (c) the putter being swingable in a manner to strike a ball at the ball zone and stroke it toward the local zone, thereby causing the impingement locus of the reflected beam to trace a detectable travel pattern providing indication as to whether or not a struck ball would travel to the local (cup) zone.

Beam detector means may be associated with the target to enable visual or audible detection of a misdirected stroke of the head or misalignment of the head, as will appear.

These and other objects and advantages of the invention, as well as the details of an illustrative embodiment, will be more fully understood from the following specification and drawings, in which:

DRAWING DESCRIPTION

FIG. 8 is a frontal view of a target body;

FIG. 9 is a diagrammatic view of a target and associated circuitry; and

FIGS. 10 and 11 show modified reflection and light transmission arrangements.

DETAILED DESCRIPTION

Figure 1:
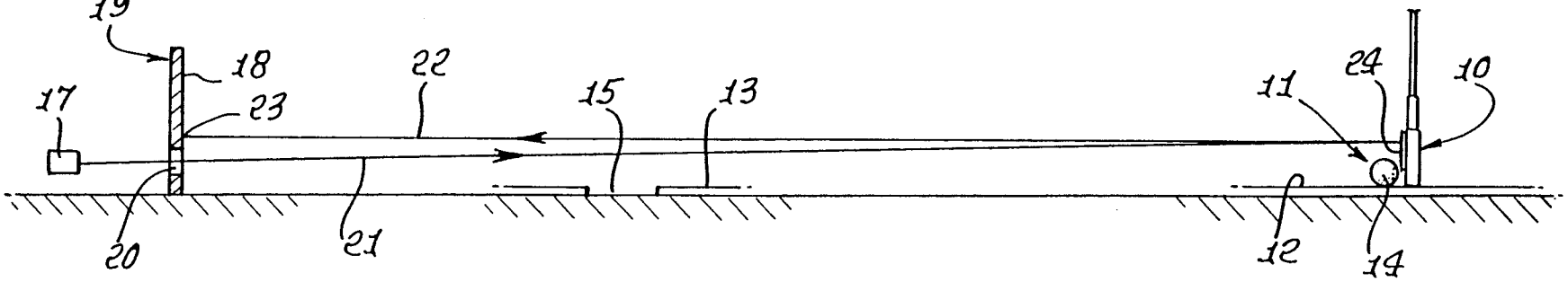
FIGS. 1 and 2 are side elevations showing operation of means incorporating the invention, i.e., performing the method of the invention.
Figure 2:
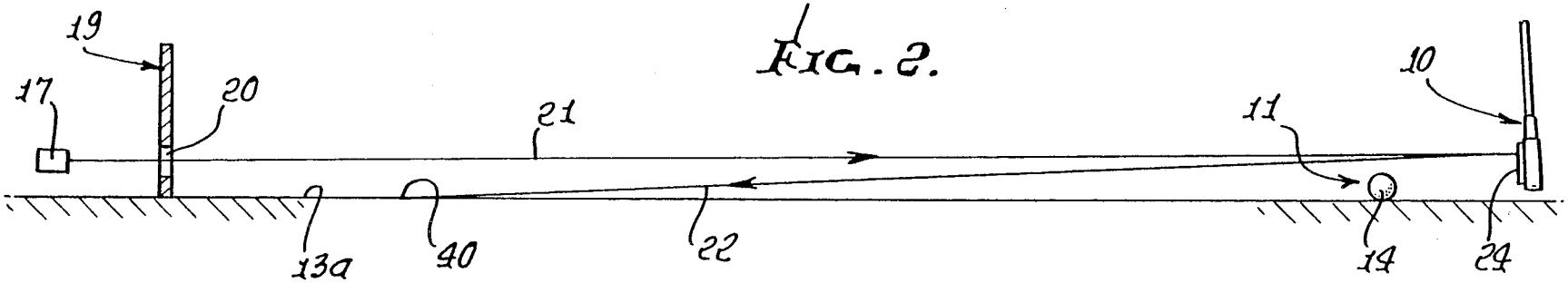

In FIGS. 1 and 2, a putter head 10 is located in ball addressing position directly behind a ball zone 11 on or at a putting surface 12. That surface may be an actual green, or an artificial green, as on a pad 13. A golf ball 14 may or may not be located at or on the ball zone 11. A local zone toward which the ball is to be putted or stroked is indicated at 15, and may have the shape and diameter of a cup rim, as at an golfing green hole. Thus, the zone may be real or simulated. It is the objective to swing the putter so as to accurately stroke the ball directly toward the zone 15. As stated, a ball 14 need not be used, it being the alignment and stroking of the putter which is to be accurately tracked or determined.

A beam generator 17 is provided to direct a reflectable beam at the putter for reflection toward a target surface to impinge on that surface at an impingement locus (or loci defining a track path as the putter is swung). See for example surface 18 of target body 19 facing toward the putter. The generator 17 may advantageously be located behind the target board as shown, and a hole 20 may be provided in the board to pass the beam 21 directed toward the putter. After reflection, the beam returns at 22 toward the impingement locus or loci at the board surface. Initially, the reflected beam (for example a light or laser beam) may impinge at "spot" 23.

Figure 4:
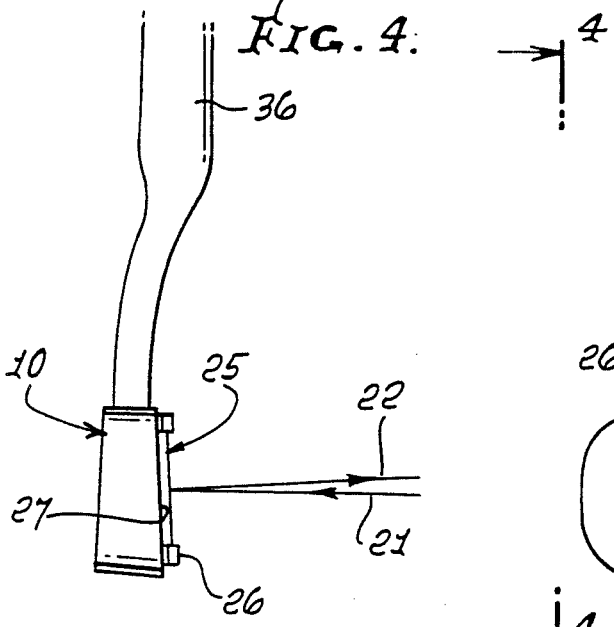
FIG. 4 is an end elevation taken on lines 4—4 of FIG. 3.
Figure 3:
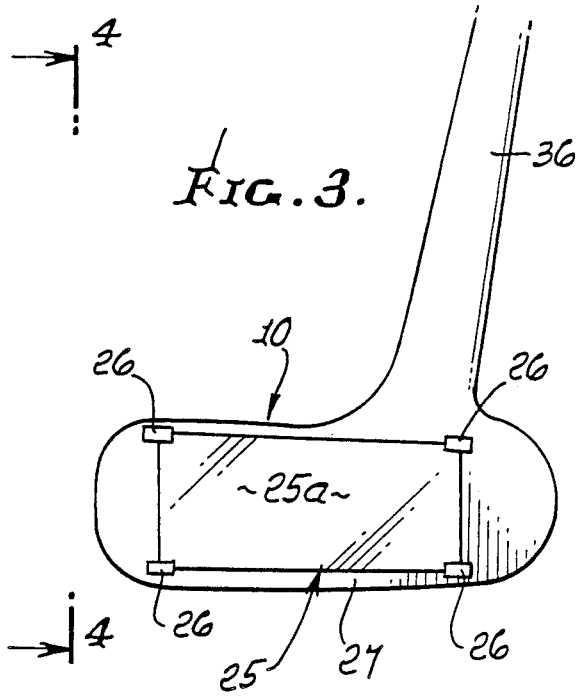
FIG. 3 is a front view of the ball striking face of a putter having a mirror surface.
Figure 5:
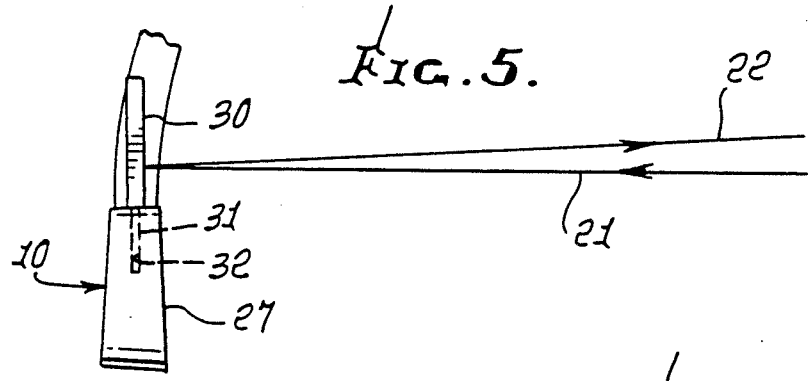
FIGS. 5–7 are views like FIGS. 3 or 4 showing alternate, i.e., offset locations of the mirror surface relative to the head.
Figure 6:
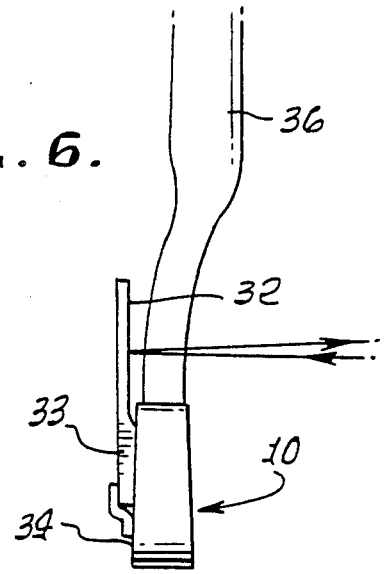
Figure 7:
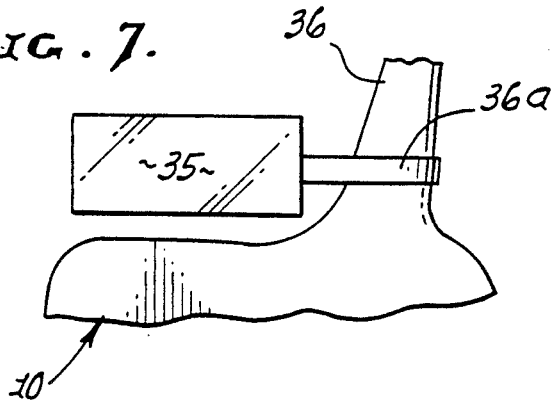

The reflective surface 24 at the putter may be provided by a polished surface on the putter, or by the surface 25*a* of a mirror 25 attached to the putter face. One method of temporary attachment of the mirror is shown in FIGS. 3 and 4 to consist of adhesive tape sections 26 taping the mirror corners to the head face 27. Alternately, the mirror may have an adhesive at its rear surface to adhere to the putter. The mirror surface is thus parallel to the putter face. FIG. 5 shows an alternate method of carriage of the mirror 30 by the putter head, i.e., a leg or legs 31 integral with the mirror extend downward into an opening or openings 32 in the putter head. In FIG. 6, the mirror 32 is located above the putter head and has a downward leg or support 33 attached to the rear 34 of the head. In FIG. 7, the mirror 35 is connected at 36*a* to the putter shaft 36, to project directly above the head 10.

FIG. 2 illustrates swinging of the putter in a manner to strike a ball at the zone 11 and stroke it toward the local zone 15, thereby causing the impingement locus of the reflected beam to trace a detectable travel pattern providing indication as to whether or not a struck ball would travel to the local zone. As the putter is swung back, the reflected beam 22 drops, and the impingement locus or spot travels downward and off the target surface 18, and onto the putting surface, as on surface 13*a* of green simulating pad 13. At the extreme rearward position of the head, the beam strikes the surface 13*a*, as at spot 40, visible to the golfer. Then, as the putter is swung forwardly toward and through the ball zone, the spot 40 travels back toward and upwardly on the target surface toward and across the initial locus 23, which may be indicated by a marker on the target surface (the original set up being such as to initially reflect the beam onto the marker). If the head alignment, and/or stroking, is or are misdirected on the forward stroke of the head, the impingement spot will not cross the initial locus 23 but will be at one or the other side of that locus. This provides a very accurate visual tracking method or means due to the magnification afforded by the relatively great distance of the head from the target, relative to the head swing length.

FIG. 8 shows a target board or body 19 with surface 18 in frontal, perspective view. The vertical plane of the reflected beam 22 is slightly offset laterally relative to the vertical plane of the beam 21 passing to the mirror. Thus, the reflected beam can track, uninterruptedly and visually observably, back along the putting surface 13 and up the board surface 18 toward initial locus 23, or to the left or right of the locus in case of error. Note graduations 50 below locus 23.

Detectors 51 and 52 may be located at the board surface, or behind the board, as in FIG. 9, to detect such erroneous travel of the reflected beam. Slots may be provided in the board at 51*a* and 52*a* to pass beam 22 toward 51 and 52. Vertical slots or lines 51*a* and 52*a* may be spaced apart at 2 inch intervals to indicate a 1 inch deviation (left or right) from the underline of the cup. Additional vertical lines for indicating lateral deviation appear at 151. Circuitry 54 is connected with such detectors, and also with visual displays 55 and 56 on the board, as in FIG. 8 to energize one or the other of such displays in case of reflected beam erroneous travel to the left or right, as referred to.

Another detector 60 ma be located at the initial locus 23 to detect reflected beam travel back up through that locus, indicating a correct stroke of the putter. A center visual display 61 may then be energized by the circuitry 54 to which detector 60 is also connected. Audible alarms can be provided to be activated when the beam deviates predetermined amounts.

Figure 10:
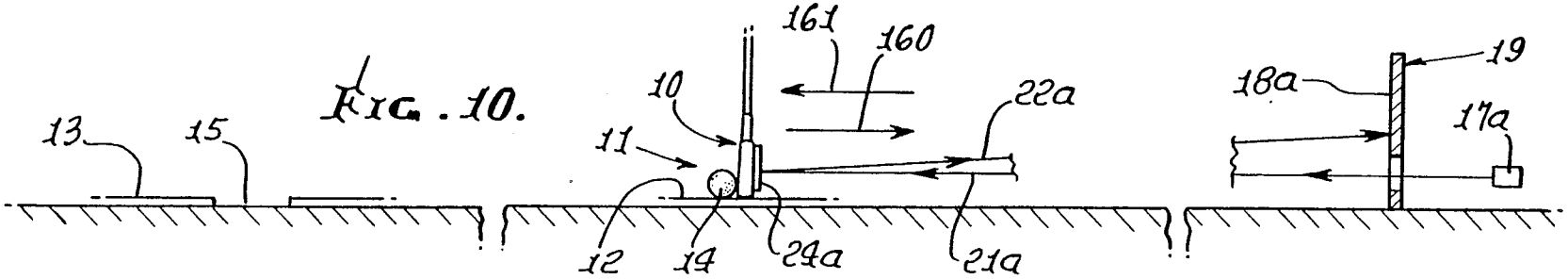

In FIG. 10, the arrangement is the same as in FIG. 1 except that the target body 19 is at the opposite (rear side of the putter head 10). The beam 21*a*, generated at 17*a*, is reflected off the rear side, 24*a*, of the putter head (or off a mirror at that rear side, or otherwise carried by the head) for reflected travel at 22*a* toward the target surface 18*a* as the putter is back-stroked in direction 160, and forward stroked in direction 161. The local (cup) zone appears at 15, as before.

In FIG. 11, the putter head 169 is to be forward stroked in direction 170. The light beam arrangement is like that of FIG. 1, and a mirror surface 172 on the putter front face reflects the beam 21, toward a target 19 (as in FIG. 1). In addition, a light beam 179 is passed downwardly in or adjacent the shaft 181, and through the head or hosel, as indicated at 180. The beam strikes the ground at 182, and traces a visible path on the ground as the head is swung. An optical fiber means may be provided within the shaft and head to conduct the beam. See U.S. Pat. No. 4,456,257 in this regard. If desired, the optical fiber can be deviated as at 180*a* to project the beam 179 forwardly of the head, providing an illuminated spot at 182*a* just forward of the head for high visibility during the putter stroke. See also beam source 195.

Accordingly, a very accurate, simple and effective method and apparatus is or are provided to teach the golfer a correct stroking of his putter.

The invention is also applicable to golf clubs (as for example irons or woods) other than putters.

I claim:

1. In the method of teaching and learning putting, and employing a putter head and a light reflective surface, a golf ball zone, a light beam generator, a beam target surface, and a local cup simulating zone toward which a putter struck ball travels on a putting surface, the steps that include:

(a) connecting said reflective surface to the head to project directly above the head, and locating the putter head directly behind said ball zone on said putting surface, (b) operating the generator to direct a light beam at the reflective surface producing a light beam reflected toward said target surface to impinge thereion producing an impingement locus, (c) and swinging the putter in a manner to strike a ball at said zone and stroke it toward said local zone, thereby causing the impingement locus of the reflected beam to trace a detectable travel pattern providing indications as to whether or not a struck ball would travel to said local zone, and where stroke deviations occurred, (d) said method including providing a target body to define a substantially vertically upstanding first portion of said target surface, said first portion having produced thereon a track path, locating said first portion behind said local cup simulating zone and orienting said first portion of the target surface to face toward the putter head, causing said impingement locus to trace a travel pattern along said track path, as the putter is swung, (e) the putting surface forming a second portion of said target surface, and the putter being swung and said reflective surface oriented to cause the impingement locus to visibly travel down and off the first portion of the target surface onto the second portion of the target surface along a second path in the general direction of said local zone, and then to visibly travel back along said second path and off said second portion of the target surface and back onto and upwardly on said first portion of the target surface, (f) positioning said generator such that vertical plane of said reflected beam directed toward said target surface is located relative tot he vertical plane of said light beam directed toward the reflective surface, so as to produce an uninterrupted and visually observable travel path of said impingement locus as it travels along said first portion and said second portion of said target surface.

2. The method of claim 1 including providing said local zone to have the shape of a cup rim at a golfing green hole.

3. The method of claim 1 including providing a golf ball at said ball zone to be struck by the putter.

4. The method of claim 1 including providing the light reflective surface at one of the following sides of the putter for reflecting said beam:

(i) the side of the putter facing said local zone, (ii) the side of the putter facing away from said local zone.

5. The method of claim 1 wherein said light reflecting surface is a mirror.

6. The method of claim 1 wherein said generator is operated to produce a laser beam directed toward said putter.

7. The method of claim 1 including passing another light beam downwardly proximate the head to intersect the putting surface and trace a visible spot travel path as the putter is swung.

8. In apparatus for teaching and learning putting, and employing a putter head and a light reflective surface, a golf ball zone, a light beam generator, a beam target surface, and in association with a local cup simulating zone toward which a putter struck ball travels on a putting surface, the combination that includes:

(a) the putter head located directly behind said ball zone on said putting surface, the reflective surface connected to said head to project directly above the head, (b) the generator operating to direct a light beam at the reflective surface producing a light beam reflected toward said target surface to impinge thereon producing an impingement locus, (c) the putter being swingable in a manner to strike a ball at said zone and stroke it toward said local zone, thereby causing the impingement locus of the reflected beam to trace a detectable travel pattern providing indication as to whether or not a struck ball would travel to said local zone, (d) a target body located to define a substantially vertically upstanding first portion of said target surface, said first portion having produced thereon a track path, and said first portion located behind said local cup simulating zone, said first portion of the target surface oriented to face towards the putter head for causing the impingement locus to trace a travel pattern along said track path as the putter is swung, the putting surface forming a second portion of the target surface, (e) detector means associated with said target body to be responsive to said beam impingement travel to detect an erroneous travel pattern of the impingement locus across the surface of said first portion of the target surface, after the impingement locus has visibly traveled down and off said first portion of the target surface onto said second portion of the target surface in the general direction of said local zone, and then has visibly traveled back along said second portion of the target surface and back onto and upwardly on said first portion of the target surface, with (f) said generator having a position such that the vertical plane of said reflected beam directed toward said target surface is located relative to the vertical plane of said light beam directed toward the reflective surface, so as to produce an uninterrupted and visually observable travel path of said impingement locus as it travels along the first portion and said second portion of said target surface.

(g) and including circuitry and indicator means operatively connected with said detector means to indicate to the golfer said erroneous travel.

9. The combination of claim 8 wherein said local zone has the shape of a cup rim at a golfing green hole.

10. The combination of claim 8 including a golf ball at said ball zone, to be struck by the putter.

11. The combination of claim 8 wherein a light reflective surface is provided at the side of the putter facing said local zone, for reflecting said beam.

12. The combination of claim 9 wherein said light reflective surface comprises a mirror at the side of the putter facing said local zone for reflecting said beam.

13. The combination of claim 8 wherein said generator includes circuitry to produce a laser beam directed toward said putter.

14. The combination of claim 13 wherein said beam is oriented to pass through the target body toward the putter head.

15. The combination of claim 8 including a golfing green simulating pad defining said putting surface.

16. The combination of claim 8 including means associated with the putter head to pass a light beam downwardly proximate the head to impinge on the putting surface and trace a visible travel path as the head is swung.

17. A putter for use in apparatus for teaching and learning putting, and employing a golf ball zone, a light beam generator, a beam target surface, and in association with a local cup simulating zone toward which a putter struck ball travels on a putting surface, the combination that includes:

(a) the putter having a head to be located directly behind said ball zone on said putting surface, (b) said target surface forming a first portion behind said local cup simulating zone, the putting surface forming a second portion of the target surface, (c) a light reflecting surface on the putter the generator operating to direct a light beam at the reflective surface, said reflective surface to variably reflect a first light beam from said generator toward said first portion of the target surface as the putter is stroked to strike the ball at said ball zone, (c) and including means associated with the putter head to pass a second light beam downwardly proximate the head to impinge on the putting surface and trace a visible travel path as the head is swung.

* * * * *